United States Patent [19]

Osaki

[11] Patent Number: 4,771,522

[45] Date of Patent: Sep. 20, 1988

[54] APPARATUS FOR MANUFACTURING SLIDE FASTENERS

[75] Inventor: Tatsuo Osaki, Uozu, Japan

[73] Assignee: Yoshida Kogyo K. K., Tokyo, Japan

[21] Appl. No.: 110,860

[22] Filed: Oct. 21, 1987

[30] Foreign Application Priority Data

Oct. 28, 1986 [JP] Japan ..... 61-165237[U]
Oct. 29, 1986 [JP] Japan ..... 61-257430
Oct. 30, 1986 [JP] Japan ..... 61-259343

[51] Int. Cl.[4] ..... B23P 19/04; B21D 53/54

[52] U.S. Cl. ..... 29/33.2; 29/408; 29/766

[58] Field of Search ..... 29/33.2, 34 A, 408, 29/409, 410, 712, 767, 768, 766

[56] References Cited

U.S. PATENT DOCUMENTS 3,714,698 2/1973 Fukuroi ..... 29/33.2 X
3,792,521 2/1974 Kawakami ..... 29/768
4,307,500 12/1981 Kuse ..... 29/33.2
4,365,403 12/1982 Ooura ..... 29/408
4,494,293 1/1985 Kawakami ..... 29/766 X
4,495,695 1/1985 Umino ..... 29/767
4,625,398 12/1986 Kando ..... 29/33.2 X
4,627,807 12/1986 Kuse ..... 29/34 A X

FOREIGN PATENT DOCUMENTS 881812 9/1971 Canada ..... 29/33.2
0099065 1/1984 European Pat. Off. ..... 29/34 A
0173156 5/1986 European Pat. Off. ..... 29/33.2
1782885 11/1979 Fed. Rep. of Germany ..... 29/768
2445118 12/1979 France ..... 29/33.2
39-19216 9/1964 Japan ..... 29/33.2
44-12543 6/1969 Japan ..... 29/768
44-12544 6/1969 Japan ..... 29/766
44-12545 6/1969 Japan ..... 29/768
2044140A 10/1980 United Kingdom ..... 29/33.2

*Primary Examiner*—William R. Briggs
*Attorney, Agent, or Firm*—Hill, Van Santen, Steadman & Simpson

[57] ABSTRACT

An apparatus for automatically manufacturing slide fasteners of a desired length from a slide fastener chain of a continuous length has a stop unit which is adjustably disposed in a travelling path of a grip unit downstream thereof and which includes a stop movable between an operative position to stop the grip unit and an inoperative position not to stop the grip unit.

5 Claims, 5 Drawing Sheets

APPARATUS FOR MANUFACTURING SLIDE FASTENERS

BACKGROUND OF THE INVENTION

1. Field of the Invention

The present invention relates to an apparatus for automatically manufacturing slide fasteners of a desired length from a continuous slide fastener chain, and more particularly to a stop unit of such apparatus.

2. Description of the Prior Art

As disclosed in Japanese Patent Publication No. 44-12543 and reillustrated here in FIG. 12 of the accompanying drawings, a known apparatus for manufacturing slide fasteners from a continuous slide fastener chain has a stop unit in which a stop B detects the leading end of a pair of coupled fastener element rows A of a succeeding slide fastener chain being moved by a grip unit C and then renders the grip unit C to be stopped upon such detection.

A primary problem with the known stop unit is that since the leading end of a pair of coupled fastener element rows A of a succeeding slide fastener chain is sensed by the stop B to stop the grip unit C to thereby terminate the movement of the slide fastener chain, the slide fastener chain is apt to be damaged. Further, with such arrangement, it is difficult not only to speed up the processing of the slide fastener chain but also to select a length of prospective slide fasteners easily without restraint.

SUMMARY OF THE INVENTION

It is therefore an object of the present invention to provide a slide fastener manufacturing apparatus having an improved stop unit with which a slide fastener chain can be stopped without being damaged and with which a length of prospective slide fasteners can be selected easily without restraint.

According to the present invention, an apparatus for automatically manufacturing slide fasteners of a desired length from a slide fastener chain of a continuous length has a stop unit which is adjustably disposed in a travelling path of a grip unit downstream thereof and which includes a stop movable between an operative position to stop the grip unit and an inoperative position not to stop the grip unit.

Many other advantages, features and additional objects of the present invention will become manifest to those versed in the art upon making reference to the detailed description and the accompanying sheets of drawings in which a preferred structural embodiment incorporating the principle of the present invention is shown by way of illustrative example.

DETAILED DESCRIPTION

Figure 1:
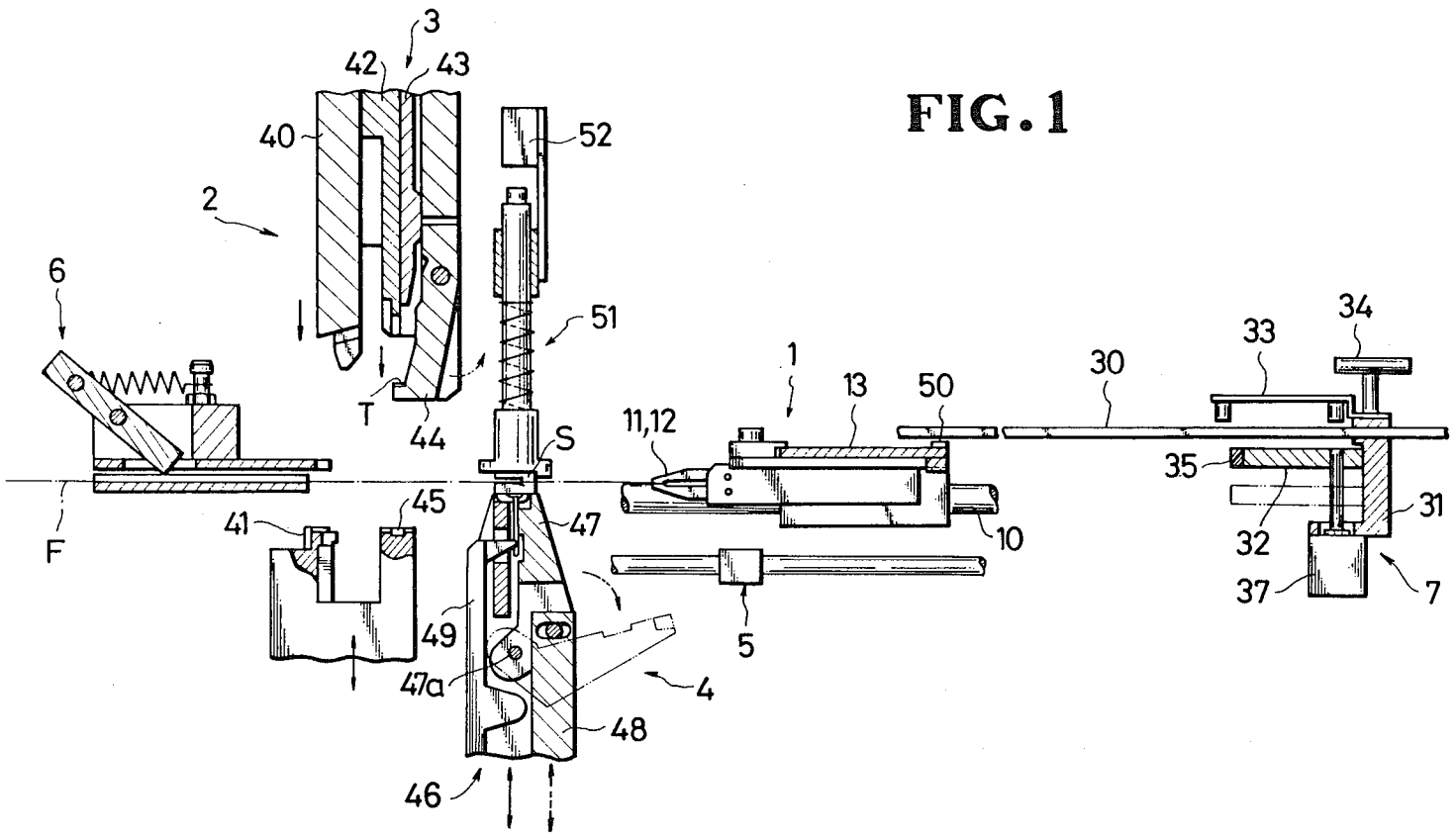
FIG. 1 is a fragmentary side elevational view, partially in cross section, of an apparatus embodying to the present invention.

FIG. 1 shows a slide fastener finishing apparatus for automatically manufacturing slide fasteners (FIGS. 10 and 11) of a desired length from a continuous slide fastener chain F.

The apparatus generally comprises a grip unit 1, a cutter unit 2, a bottom-stop attaching unit 3, a slider holding unit 4, a slider-holding-unit control unit (hereinafter referred to as control unit) 5, a slide-fastener-chain detecting unit 6, and a grip-unit stopping unit (hereinafter referred to as stop unit) 7.

As shown in FIGS. 1 through 6, the grip unit 1 is slidably mounted on a pair of parallel guide rods 10, 10 extending parallel to a path of the slide fastener chain F and is movable on and along the guide rods 10, 10 in response to the action of an air cylinder (not shown).

Figure 5:
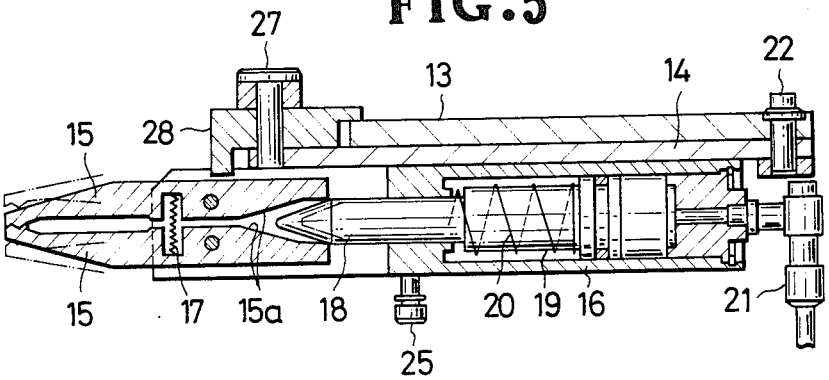
FIG. 5 is a longitudinal cross-sectional view of FIG. 4.
Figure 6:
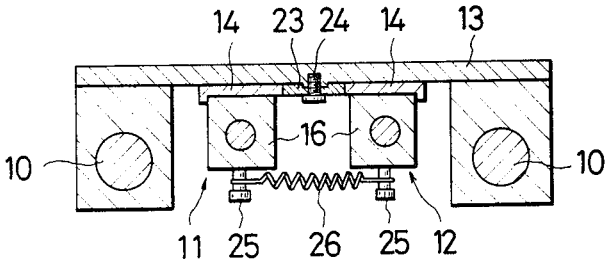
FIG. 6 is a transverse cross-sectional view of FIG. 4.

The grip unit 1, as best shown in FIGS. 5 and 6, has at its upstream end a pair of grippers 11, 12 for gripping respective leading ends of a pair of stringers of the slide fastener chain F. The two grippers 11, 12 are attached to a lower side of a support plate 13 via a pair of attachment plates 14, 14 pivotally connected at respective downstream ends to the support plate 13 by a pair of pivots 22, 22, respectively. The support plate 13 is mounted astride the guide rods 10, 10. The two grippers 11, 12 are identical in construction and are symmetrical with respect to a vertical plane extending centrally along the path of the slide fastener chain F. Therefore, following is a detailed description of one of the grippers 11, with the description of the other gripper 12 omitted.

Figure 3:
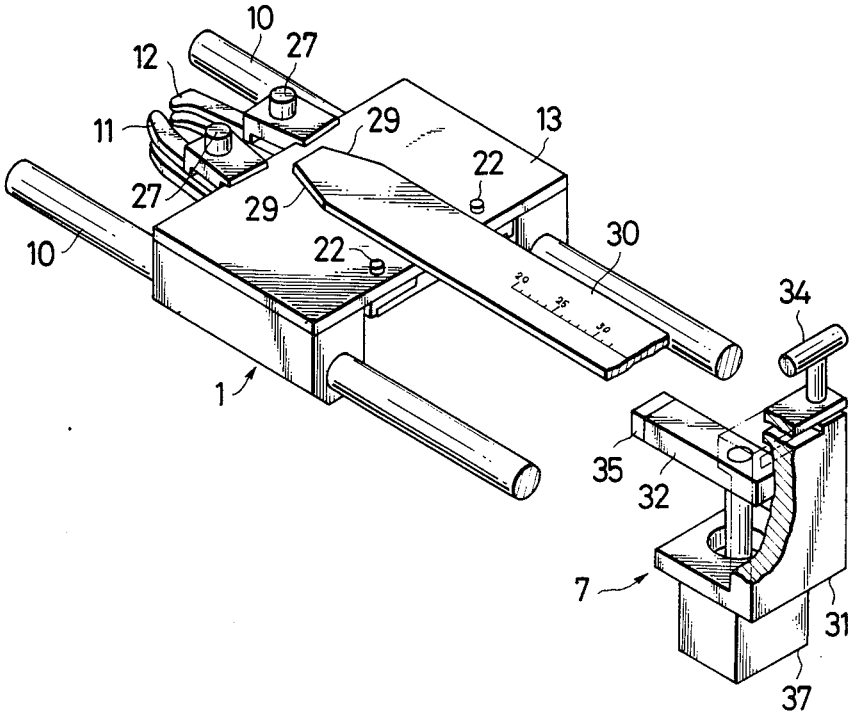
FIG. 3 is a perspective view of FIG. 2.

As shown in FIG. 3, the gripper 11 includes upper and lower grip members 15, 15 pivotally connected at their intermediate portions to a gripper body 16 and normally urged by a spring 17 so as to normally open at their upstream ends. The upper and lower grip members 15, 15 have at their downstream ends a pair of opposite sloping surfaces 15*a*, 15*a*. When a tapered piston rod 18 of an air cylinder 19 mounted in the gripper body 16 is extended to enter between the sloping surfaces 15*a*, 15*a*, the upper and lower grip members 15, 15 are closed at their upstream ends against the bias of the spring 17. The piston rod 18 is normally urged by a spring 20 to retract from the grip members 15, 15 and is projectable between the downstream ends of the upper and lower grip members 15, 15 as air is supplied to the air cylinder 19 via a supply pipe 21.

As shown in FIG. 6, the two grippers 11, 12 are laterally spaced from each other by a predetermined distance. A distance retaining plate 23 is adjustably attached to the support plate 13 between the attachment plates 14, 14 by a screw 24 extending through an slot in the distance retaining plate 23. The two gripper bodies 16, 16 have substantially centrally at their bottoms a pair of pins 25, 25, between which an extension spring 26 is mounted to normally urge the upstream ends of the two grippers 11, 12 toward each other.

Figure 4:
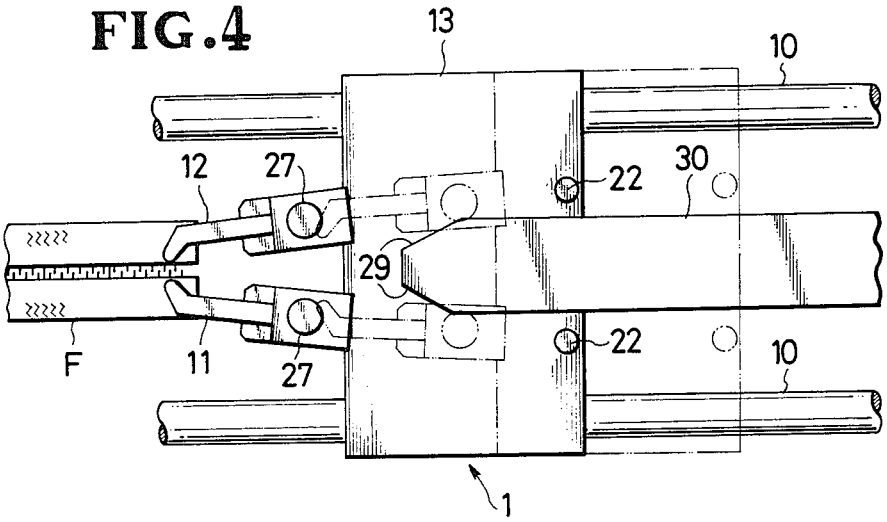
FIG. 4 is a plan view of the grip unit of FIGS. 2 and 3.
Figure 7:
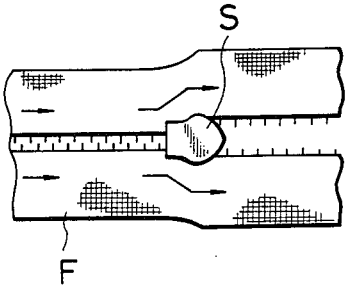
FIG. 7 is a fragmentary plan view of a pair of initially coupled fastener stringers being progressively uncoupled.

As shown in FIGS. 2 through 5, the two grippers 11, 12 have near their upstream ends a pair of guide pins 27, 27 each mounted on the top of the respective gripper 11, 12 via a guide plate 28. The two guide pins 27, 27 are engageable with a pair of cam surfaces 29, 29 at a tapered end of a cam plate 30 disposed parallel to the path of the slide fastener chain F. When the grip unit 1 is moved downstream along the path of the slide fastener chain F, the guide pins 27, 27 roll on the cam surfaces 29, 29 of the cam plate 30, causing the two grippers 11, 12 to pivotally move about the respective pivots 22, 22 so that their upstream ends of the grippers 11, 12 are moved away from each other against the bias of the spring 26, as shown in FIG. 4. Thus the two grippers 11, 12 are capable of spreading apart to cope with the condition wherein the initially coupled stringers of the slide fastener chain F are progressively uncoupled by a slider S as shown in FIG. 7.

Figure 8:
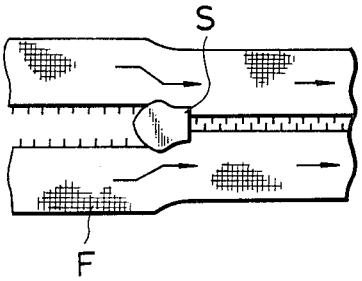
FIG. 8 is a view similar to FIG. 7, showing the initially uncoupled fastener stringers being progressively coupled.
Figure 9:
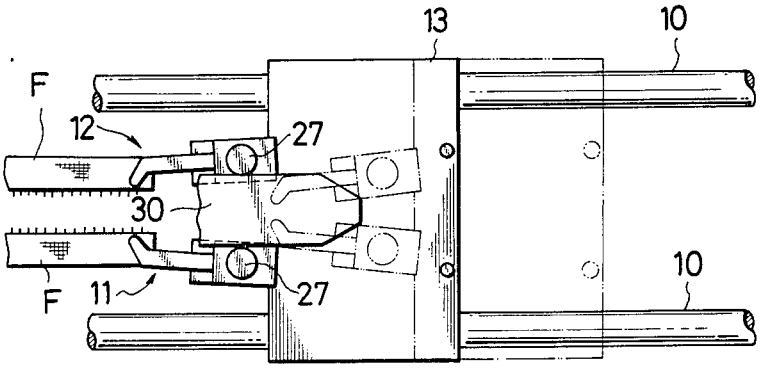
FIG. 9 is a view similar to FIG. 4, but showing a modified grip unit.

Althrough the tapered end of the cam plate 30 is directed upstream of the path of the slide fastener chain F in the embodiment discussed above, the tapered end of the cam plate 30 may be directed downstream of the path of the slide fastener chain F as shown in FIG. 9. With this alternative arrangement of the cam plate 30, the upstream ends of the two grippers 11, 12 are movable toward each other when the grip unit 1 is moved downstream of the path of the slide fastener chain F. Thus the two grippers 11, 12 are movable so as to cope with the condition wherein the initially uncoupled stringers of the slide fastener chain F are progressively coupled by the slider S as shown in FIG. 8.

Figure 2:
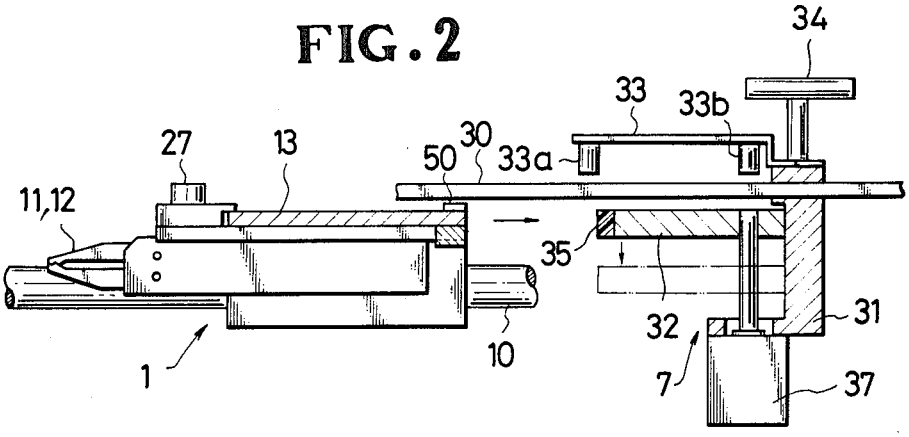
FIG. 2 is an enlarged side elevational view, partially in cross section, of a grip unit and a stop unit of the apparatus.

The downstream movement of the grip unit 1 is stopped by the stop unit 7. As shown in FIGS. 1, 2 and 3, the stop unit 7 includes a slide 31, a stop 32, an proximity detector 33, and an adjusting means 34.

The slide 31 is slidably mounted on the cam plate 30 and is adjustably secured by the adjusting means 34 at a selected position corresponding to a desired length of slide fasteners to be manufactured. The proximity detector 33 is mounted on the upper portion of the slide 31. The stop 32 is disposed at the upstream side of the slide 31 and is supported thereby. When a magnet 14 carried on the downstream end of the grip unit 1 reaches a first proximity switch 33*a* of the proximity detector 33, the first proximity switch 33*a* is actuated to produce an electrical signal to deenergize a non-illustrated air cylinder (which is a drive means for the grip unit 1). Thereafter the grip unit 1 continues moving downstream under the force of inertia and does not perfectly stop until its downstream end strikes the stop 31. A shock absorber 35 is mounted on a distal end of the stop 32 for minimizing the shock of collision. Thus the movement of the slide fastener chain F is terminated.

Upon termination of the movement of the slide fastener chain F, a predetermined slide-fastener length of the slide fastener chain F is cut by the cutter unit 3, and at the same time, a bottom stop T is attached to the slide fastener chain F of the slide-fastener length by the bottom-stop attaching unit 3 which is disposed immediately downstream of the cutter unit 2.

When the cutting of the slide fastener chain F and the attachment of the bottom stop T have thus been completed, the stop 32 is lowered on the slide 31 from the solid-line position to the phantom-line position in FIGS. 1 and 2 by an air cylinder 37. In this phantom-line position, the stop 32 is inoperative. The the grip unit 1 is driven again to further move downstream, pulling the slide fastener chain F of the slide-fastener length to such an extent that its trailing end is moved past the cutter unit 3, the bottom-stop attaching unit 3, and the slider holding unit 5. When the magnet 14 carried on the downstream end of he grip unit 1 reaches a second proximity switch 33*b* of the proximity detector 33 which switch is spaced a predetermined distance from the first proximity switch 33*a* downstream thereof, the second proximity switch 33*b* is actuated to produce an electrical signal to deenergize again the non-illustrated air cylinder as the drive means for the grip unit 1. Thereafter the grip unit 1 continues moving downstream under the force of inertia and does not perfectly stop until its downstream end strikes an upstream surface of the slide 31. Thus the movement of the slide fastener chain F is terminated. Then the two grippers 11, 12 are actuated to open, releasing the slide fastener chain F of the slide-fastener length to fall for discharge. Thus the slide fastener of a desired length has been manufactured.

The adjusting means 34 is mounted on the top of the slide 31 for adjustably fastening the slide 31 to the cam plate 30. The adjusting means 34 may include a threaded member; when unfastened by turning the threaded member 34 in one direction, the slide 31 is allowed to move along the cam plate 30 to a desired position, whereupon the slide 31 is fastened to the cam plate 30 by turning the threaded member 34 in the reverse direction. The upper surface of the cam plate 30 is marked with degrees so that the length of the slide fastener chain F to be cut can be selected simply by setting the slide 30 at a corresponding degree.

As shown in FIG. 1, the cutter unit 2 is disposed immediately downstream of the slide-fastener-chain detecting unit 6 and includes a cutter 40 disposed above the path of the slide fastener chain F and cooperative with a die 41 disposed below the path of slide fastener chain F.

The bottom-stop attaching unit 3 is immediately downstream of the cutter unit 2 and includes a forming punch 42, a cutting punch 43, a bender 44, and a die 45 disposed below the path of the slide fastener chain F. A metal strip is supplied to the bender 44 and is cut into a predetermined length by the cutting punch 43. Then the predetermined length of the metal strip is bent by the forming punch 42 to provide a bottom stop T. The forming punch 42 is cooperative with the die 45 to attach the bottom stop T to the slide fastener chain F. This attaching operation takes place concurrently with the cutting operation when the grip unit 1 stops at the first time.

The slider holding unit 4 is disposed immediately downstream of the bottom-stop attaching unit 3 for threading the slider S onto the slide fastener chain F. The slider holding unit 4 includes a slider holder 46 disposed below the path of the slide fastener chain F and composed of a slider retaining lever 47, a retaining-lever moving lever 48, and a clamper 49. When the retaining-lever moving lever 48 is lowered, the slider retaining lever 47 is pivotally moved about a pivot 47*a* from an upright position (indicated by solid lines) and a substantially horizontal position (indicated by phantom lines in FIG. 1, whereupon a slider S is supplied to the top of the slider holder 46 via a slider chute (not shown). Then the retaining-lever moving lever 48 is raised to return the slider retaining lever 47 to the original upright position. In this upright position, the slider retaining lever 47 is cooperative with the clamper 49 to hold a pull tab of the slider S. The slider holder 46 with the slider S thus retained thereon is moved upwardly until the slider S reaches the path of the slide fastener chain F where the slide fastener chain F is threaded through the slider S. A slider detecting unit 51 is disposed above the path of the slide fastener chain F in vertical alignment with the slider holder 46 for contacting the slider S on the slider holder 46 to thereby detect the presence of a slider S. In the absence of a slider S on the slider holder 46, a switch 52 carried on the slider detecting unit 51 is actuated to produce an electrical signal terminating the operation of the apparatus.

Figure 10:
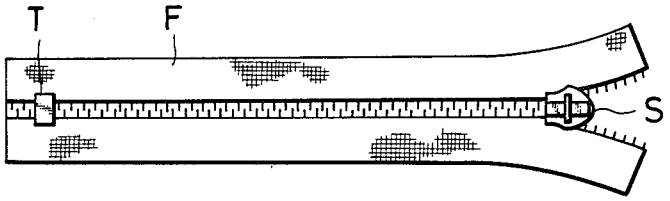
FIGS. 10 and 11 are plan views of different slide fasteners manufactured by the apparatus according to the present invention.
Figure 11:
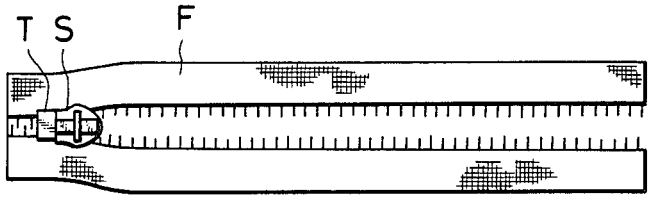
Figure 12:
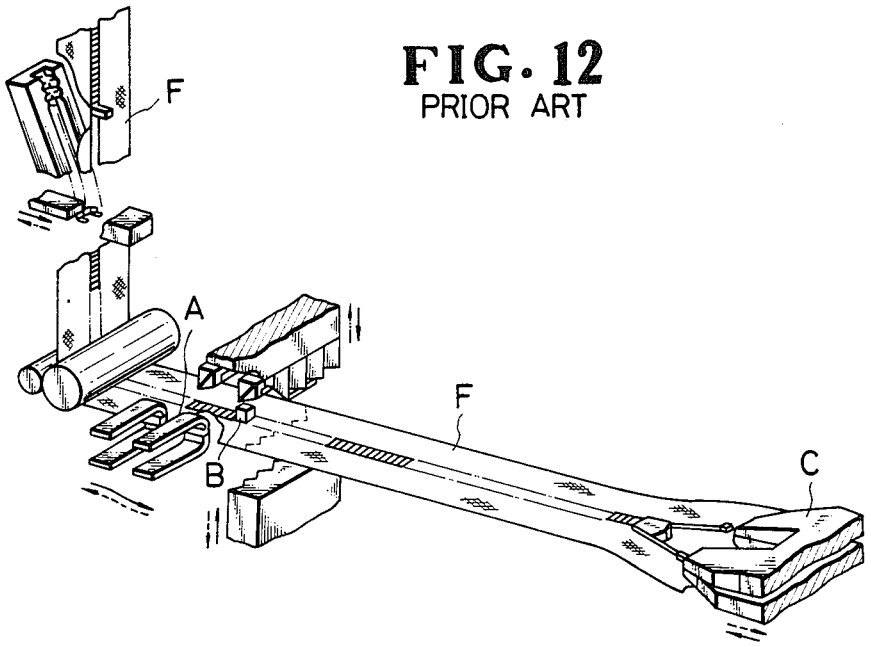
FIG. 12 PRIOR ART
FIG. 12 is a fragmentary perspective view of a prior art apparatus.

The control unit 5 is operative to control the time when the slider holding unit 4 should release the slider S. The control unit 5 includes a limit switch adjustably mounted on a rod parallel to the guide rods 10. This limit switch is set at a selected position on the rod; when the grip unit 1 reaches such a selected position, the limit switch is energized to produce an electrical signal to the slider holding unit 4. Upon receipt of the electrical signal, the slider retaining lever 47 is pivotally moved to release the slider S, thus allowing the slider S to be conveyed together with the slide fastener chain F. Thus by varying the position of the limit switch on the rod, it is possible to make various kinds of slide fasteners each carrying the slider S at a different position, as shown in FIGS. 10 and 11.

According to the present invention, since the stop unit 7 is disposed in the travelling path of the grip unit 1 downstream thereof to stop the grip unit 1, it is possible to terminate the movement of the slide fastener chain F easily without impairing the slide fastener chain F. Further, since the stop 32 of the stop unit 7 is movable to an inoperative position not to stop the grip unit 1, it is possible to discharge the finished slide fasteners easily in order. Furthermore, since the stop unit 7 is adjustably disposed in the travelling path of the grip unit 1, it is possible to select a desired length of the slide fasteners to be manufacture.

What is claimed is:

1. An apparatus for automatically manufacturing a slide fastener of a predetermined length from a slide fastener chain of a continuous length, comprising:

(a) a horizontally reciprocable grip unit for gripping a leading end of the slide fastener chain and for moving the slide fastener chain along a longitudinal path;

(b) a grip-unit stopping unit adjustably disposed in the path of the slide fastener chain downstream of said grip unit, said stopping unit having a stop movable between an operative position in which said stop is engageable with a downstream end of said grip unit to stop the latter, and an inoperative position in which said stop is not engageable with the downstream end of said grip unit to allow the latter to continue moving;

(c) a cutter unit disposed in the path of the slide fastener chain remotely upstream of said stopping unit for cutting the slide fastener chain into a selected slide-fastener length when said grip unit is stopped by said stop;

(d) a bottom-stop attaching unit disposed immediately downstream of said cutter unit for attaching a bottom stop to the slide fastener chain of the selected slide fastener length; and (e) a slider holding unit disposed immediately downstream of said bottom-stop unit for holding a slider in the path of the slide fastener chain to thread the slider onto the slide fastener chain as the latter is moved downstream by said grip unit.

2. An apparatus according to claim 1, wherein said stopping unit further includes a slide slidably mounted on a supporting means extending parallel to the path of the slide fastener chain, and an adjusting means for adjustably securing said slide to said supporting means at a selected position corresponding to the selected slide-fastener length of the slide fastener chain to be cut, said stop being supported on said slide at an upstream side thereof.

3. An apparatus according to claim 2, wherein said stopping unit further includes an air cylinder supported on said slide and having a piston rod, said stop being connected to said piston rod and being movable vertically between said operative and inoperative positions in response to movement of said piston rod.

4. An apparatus according to claim 3, wherein said stopping unit further includes a proximity detector supported on said slide and composed of first and second proximity switches spaced a predetermined distance from each other, said grip unit having a magnet carried on a downstream end thereof, said first proximity switch being actuated, when said magnet on said grip unit reaches said first proximity switch, to produce an electrical signal for deenergizing a drive for said grip unit so that said grip unit continues moving downstream under the force of inertia until it strikes a distal end of said stop in said operative position, said grip unit being movable downstream when said grip unit is redriven by said drive and when said stop is moved to said inoperative position, said second proximity switch being actuated, when said magnet on said grip unit reaches said second proximity switch, to produce an electrical signal for deenergizing said drive for said grip unit so that said grip unit continues moving downstream under the force of inertia until it strikes said slide.

5. An apparatus according to claim 4, wherein said stop has a shock absorber mounted on the distal end thereof for minimizing the shock of collision.

* * * * *